US012270302B2

(12) United States Patent
Nakagawa et al.

(10) Patent No.: US 12,270,302 B2
(45) Date of Patent: Apr. 8, 2025

(54) TURBINE

(71) Applicant: MITSUBISHI HEAVY INDUSTRIES, LTD., Tokyo (JP)

(72) Inventors: Atsushi Nakagawa, Tokyo (JP); Eiji Konishi, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 18/031,275

(22) PCT Filed: Oct. 19, 2021

(86) PCT No.: PCT/JP2021/038576
§ 371 (c)(1),
(2) Date: Apr. 11, 2023

(87) PCT Pub. No.: WO2022/113570
PCT Pub. Date: Jun. 2, 2022

(65) Prior Publication Data

US 2023/0374907 A1 Nov. 23, 2023

(30) Foreign Application Priority Data

Nov. 25, 2020 (JP) ..... 2020-195481

(51) Int. Cl.
*F01D 11/00* (2006.01)
*F01D 9/04* (2006.01)
(Continued)

(52) U.S. Cl.
CPC ..... *F01D 11/001* (2013.01); *F01D 9/04* (2013.01); *F01D 9/041* (2013.01); *F01D 11/02* (2013.01); *F04D 29/68* (2013.01); *F04D 19/00* (2013.01)

(58) Field of Classification Search
CPC ..... F01D 11/02; F01D 11/04; F01D 11/001; F01D 11/025; F01D 9/041; F04D 29/68; F04D 19/00
See application file for complete search history.

(56) References Cited

U.S. PATENT DOCUMENTS 3,291,447 A * 12/1966 Brandon ..... F01D 5/08 415/176
9,574,452 B2 * 2/2017 Rose ..... F02C 7/045
(Continued)

FOREIGN PATENT DOCUMENTS

JP S49-009522 B1 3/1974
JP H01-110812 A 4/1989
(Continued)

OTHER PUBLICATIONS

International Search Report dated Nov. 22, 2021, issued in counterpart International application No. PCT/JP2021/038576, with English translation. (5 pages).
(Continued)

*Primary Examiner* — Michael K. Reitz
(74) *Attorney, Agent, or Firm* — WHDA, LLP

(57) ABSTRACT

A turbine includes: a rotor having a rotor body, and a plurality of rotor blades; a casing covering the rotor; and a plurality of stator blades, wherein the stator blades each include a stator blade body having formed on the surface thereof a suction part that extends in the radial direction and can suction at least a portion of working fluid, a nozzle inner peripheral member provided inward of the stator blade body in the radial direction, and a plurality of seal fins protruding
(Continued)

inward in the radial direction from the inner peripheral surface of the nozzle inner peripheral member, and an ejection port for ejecting the working fluid guided from the suction part is formed in the nozzle inner peripheral member and in a portion of seal fins more on the other side than the seal fin most on one side in the axial line direction.

7 Claims, 6 Drawing Sheets

(51) Int. Cl.

| | |
|---|---|
| ***F01D 11/02*** | (2006.01) |
| ***F04D 19/00*** | (2006.01) |
| ***F04D 29/68*** | (2006.01) |

(56) References Cited

U.S. PATENT DOCUMENTS

| | | | | |
|---|---|---|---|---|
| 10,451,084 | B2 * | 10/2019 | Subramanian | F04D 29/542 |
| 2009/0297341 | A1 * | 12/2009 | Turnquist | F16J 15/442 415/173.3 |
| 2016/0146057 | A1 | 5/2016 | Takata et al. | |
| 2016/0169015 | A1 | 6/2016 | Ishibashi et al. | |
| 2016/0169051 | A1 | 6/2016 | Takata | |
| 2018/0231026 | A1 * | 8/2018 | Namadevan | F01D 11/04 |
| 2020/0165971 | A1 | 5/2020 | Uechi et al. | |

FOREIGN PATENT DOCUMENTS

| | | | |
|---|---|---|---|
| JP | H04-104401 | A | 4/1992 |
| JP | H07-301102 | A | 11/1995 |
| JP | H10-331601 | A | 12/1998 |
| JP | H11-022410 | A | 1/1999 |
| JP | H11-303604 | A | 11/1999 |
| JP | 2013-194720 | A | 9/2013 |
| JP | 2016-113966 | A | 6/2016 |
| JP | 2018-035783 | A | 3/2018 |
| JP | 2018-138764 | A | 9/2018 |
| JP | 2019-44678 | A | 3/2019 |
| WO | 2015/015858 | A1 | 2/2015 |
| WO | 2015/015859 | A1 | 2/2015 |

OTHER PUBLICATIONS

Written Opinion dated Nov. 22, 2021, issued in counterpart International application No. PCT/JP2021/038576, with English translation. (8 pages).

* cited by examiner

TURBINE

TECHNICAL FIELD

The present disclosure relates to a turbine.

Priority is claimed on Japanese Patent Application No. 2020-195481 filed on Nov. 25, 2020, the content of which is incorporated herein by reference.

BACKGROUND ART

A gas turbine or a steam turbine mainly includes a rotor that rotates around an axis, a casing that covers the rotor from an outer peripheral side, and a plurality of stator vane stages that are provided on an inner peripheral side of the casing (refer to PTL 1). The rotor has a rotor main body extending along the axis, and a plurality of rotor blade stages that are arranged on an outer peripheral surface of the rotor main body. The stator vane stages and the rotor blade stages are arranged alternately in an axial direction. The stator vane stages include a plurality of stator vanes that are arranged in a circumferential direction. Similarly, the rotor blade stages include a plurality of rotor blades that are arranged in the circumferential direction. A fluid introduced from the outside flows into the rotor blade stages after the direction of flow thereof is changed at the stator vane stages. Accordingly, the energy of steam is converted into a rotational force through the rotor blade stages, so that the rotor rotates.

CITATION LIST

Patent Literature

[PTL 1] Japanese Unexamined Patent Application Publication No. 2018-138764

SUMMARY OF INVENTION

Technical Problem

Meanwhile, it is known that when steam passes through the vicinity of the stator vanes, a layer of a stream at which the flow velocity is low and which is called a boundary layer is formed because of the viscosity of the steam. In a case where the boundary layer develops, energy loss occurs. As a result, the efficiency of a steam turbine may decrease. Furthermore, there is also a demand for improving the efficiency of a turbine by reducing a stream (a leakage stream) of steam flowing between a stator vane seal fin and a rotor.

The present disclosure has been made to solve the above-described problems, and an object of the present disclosure is to provide a steam turbine with a further improvement in efficiency.

Solution to Problem

According to an aspect of the present disclosure for achieving the object, there is provided a steam turbine including a rotor that includes a rotor main body rotatable around an axis and a plurality of rotor blades arranged in a circumferential direction along an outer peripheral surface of the rotor main body, a casing that covers the rotor, and a plurality of stator vanes that are arranged in the circumferential direction along an inner peripheral surface of the casing. The stator vanes each include a stator vane main body that extends in a radial direction with respect to the axis and that includes a surface in which a suction portion, through which at least a portion of a working fluid flowing from one side to the other side in a direction along the axis is suckable, is formed, a nozzle inner peripheral member that is provided inside the stator vane main body in the radial direction, and a plurality of seal fins that protrude radially inward from an inner peripheral surface of the nozzle inner peripheral member and that are arranged at intervals in the direction along the axis, and an ejection port through which the working fluid introduced through the suction portion is ejected is formed in the nozzle inner peripheral member and in a portion of the seal fin that is closer to the other side in the direction along the axis than the seal fin closest to the one side in the direction along the axis is.

Advantageous Effects of Invention

According to the aspect of the present disclosure, it is possible to provide a steam turbine with a further improvement in efficiency.

DESCRIPTION OF EMBODIMENTS

First Embodiment (Configuration of Steam Turbine)

Figure 1:
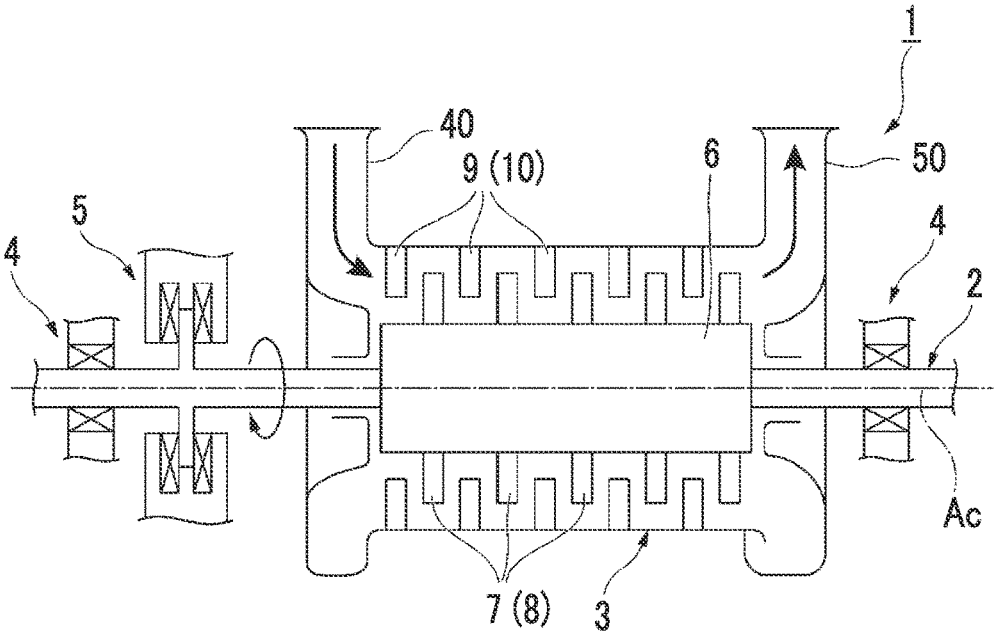
FIG. 1 is a schematic view showing a configuration of a steam turbine according to a first embodiment of the present disclosure.

Hereinafter, a steam turbine 1 (a turbine) according to a first embodiment of the present disclosure will be described with reference to FIGS. 1 to 4. As shown in FIG. 1, the steam turbine 1 includes a rotor 2, a casing 3, stator vane stages 9, journal bearings 4, and a thrust bearing 5.

The rotor 2 includes a rotor main body 6 extending along an axis Ac, and a plurality of rotor blade stages 7 that are arranged on an outer peripheral surface of the rotor main body 6 at intervals in a direction along the axis Ac. One journal bearing 4 is provided at each of both end portions of the rotor main body 6 in the direction along the axis Ac. The journal bearings 4 support the rotor main body 6 to be rotatable around the axis Ac while supporting a radial load caused by the rotor main body 6. One thrust bearing 5 is provided on one side of the rotor main body 6 in the direction along the axis Ac. The thrust bearing 5 supports a load in the direction along the axis Ac that is caused by the rotor main body 6.

Each of the rotor blade stages 7 includes a plurality of rotor blades 8 that are arranged in a circumferential direction along the outer peripheral surface of the rotor main body 6. Each of the rotor blades 8 has a blade-like cross-sectional shape of which a leading edge is on one side in the direction along the axis Ac and a trailing edge is on the other side as seen in a radial direction.

The casing 3 has a tubular shape that covers the rotor 2 from an outer side thereof. A plurality of the stator vane stages 9, which are arranged at intervals in the direction along the axis Ac, are provided on an inner peripheral surface of the casing 3. The stator vane stages 9 are arranged such that the stator vane stages 9 and the rotor blade stages 7 alternate in the direction along the axis Ac. More specifically, one stator vane stage 9 is provided on the one side in the direction along the axis Ac with respect to each of the rotor blade stages 7. Each of the stator vane stages 9 includes a plurality of stator vanes 10 that are arranged in the circumferential direction along the inner peripheral surface of the casing 3. The stator vane 10 has a blade-like cross-sectional shape of which a leading edge is on the one side in the direction along the axis Ac and a trailing edge is on the other side as seen in the radial direction.

A steam supply port 40 for introduction of steam generated on the outside is provided on one side of the casing 3 in the direction along the axis Ac. Steam introduced into the casing 3 through the steam supply port 40 collides with the rotor blade stages 7 after the direction of flow thereof is changed at the stator vane stages 9 described above. Accordingly, rotational energy around the axis Ac is applied to the rotor 2 via the rotor blade stages 7. Furthermore, a steam discharge port 50 for discharge of steam passing through the inside of the casing 3 is provided on the other side of the casing 3 in the direction along the axis Ac. In the following description, a side on which the steam supply port 40 is positioned as seen from the steam discharge port 50 (that is, the one side in the direction along the axis Ac) may be simply referred to as an "upstream side", and the opposite side may be referred to as a "downstream side".

(Configuration of Stator Vane)

Figure 2:
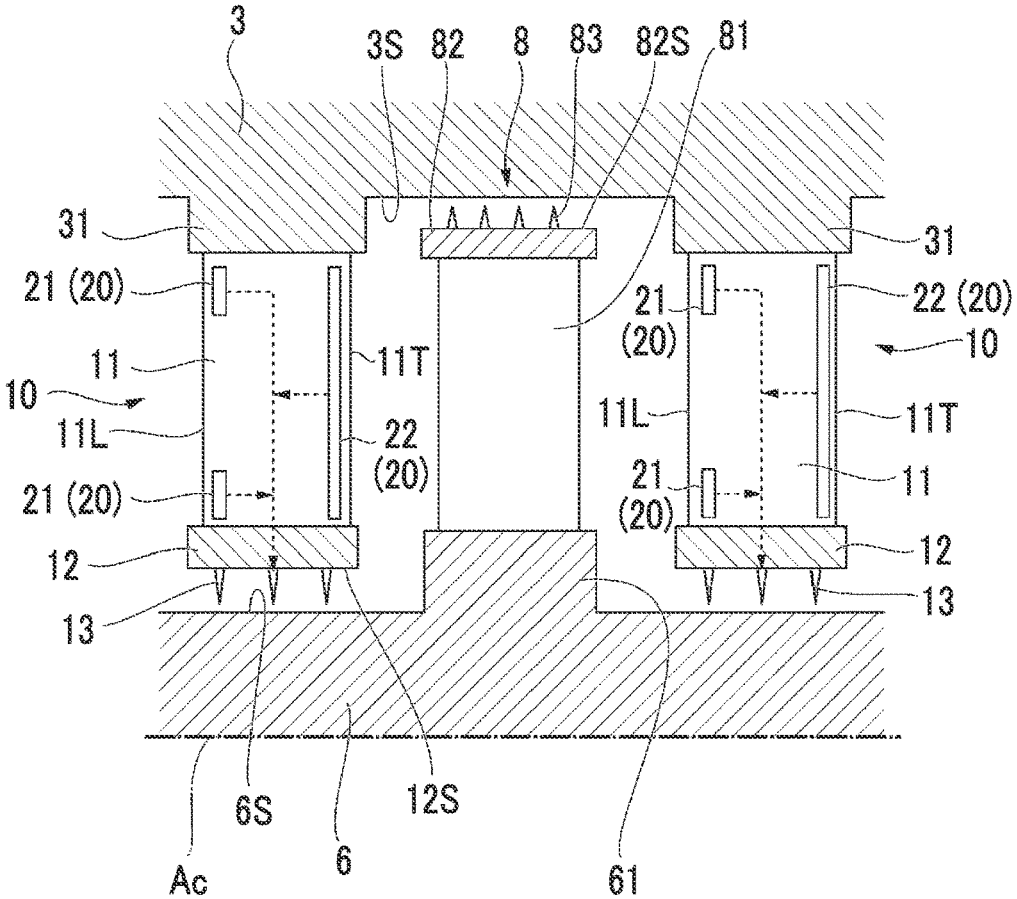
FIG. 2 is an enlarged cross-sectional view of a main portion of the steam turbine according to the first embodiment of the present disclosure.

Next, a detailed configuration of each stator vane 10 will be described with reference to FIGS. 2 and 3. As shown in FIG. 2, each stator vane 10 includes a nozzle outer peripheral member 31, a stator vane main body 11, a nozzle inner peripheral member 12, and stator vane seal fins 13 (seal fins).

The nozzle outer peripheral member 31 is attached to an inner peripheral surface 3S of the casing 3. The nozzle outer peripheral member 31 has an annular shape centered on the axis Ac. The stator vane main body 11 extends radially inward from the nozzle outer peripheral member 31. That is, the nozzle outer peripheral member 31 supports, from a radial outer side, a plurality of the stator vane main bodies 11 that are arranged in the circumferential direction.

Figure 3:
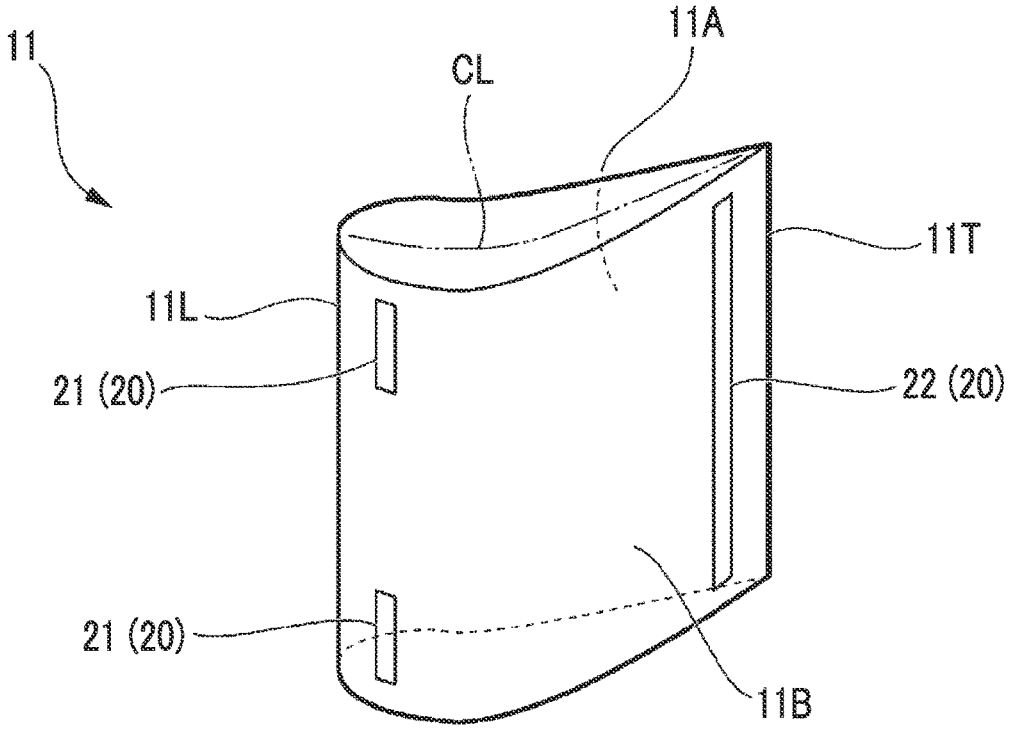
FIG. 3 is a perspective view of a stator vane according to the first embodiment of the present disclosure.

As shown in FIG. 3, an upstream-side edge of the stator vane main body 11 is a leading edge 11L, and a downstream-side edge thereof is a trailing edge 11T. A curve connecting the leading edge 11L and the trailing edge 11T (that is, a line passing through a center portion of a blade-like cross-section) is a camber line CL. A surface facing one side in the circumferential direction is a pressure surface 11A, and a surface facing the other side is a suction surface 11B with the camber line CL being a boundary therebetween. The pressure surface 11A is curvedly concave toward the other side in the circumferential direction. The pressure surface 11A faces an upstream side in the direction of flow of steam. The suction surface 11B curvedly protrudes toward the other side in the circumferential direction. The suction surface 11B faces a downstream side in the direction of flow of steam.

Suction portions 20, through which at least a portion of steam (a working fluid) flowing around the stator vane main body 11 can be sucked in, are formed at the suction surface 11B. The suction portions 20 include a pair of leading edge side suction ports 21 formed at positions close to the leading edge 11L, side and one trailing edge side suction port 22 formed at a position close to the trailing edge 11T side.

The leading edge side suction ports 21 are rectangular openings of which a longitudinal direction is the radial direction. The leading edge side suction ports 21 may have a circular shape or an oval shape. The paired leading edge side suction ports 21 are separated from each other in the radial direction. One leading edge side suction port 21 is formed in the vicinity of a radial outer end portion of the suction surface 11B, and the other leading edge side suction port 21 is formed in the vicinity of a radial inner end portion of the suction surface 11B. In addition, a distance from a radial end portion of the stator vane main body 11 to the leading edge side suction port 21 is smaller than a distance between the paired leading edge side suction ports 21. Furthermore, the positions of the paired leading edge side suction ports 21 in the direction along the axis Ac are the same as each other. Note that being "the same" means being substantially the same positions, and design tolerances and manufacturing errors are allowed. The same applies to the following description. Note that it is also possible to adopt a configuration in which the positions of the paired leading edge side suction ports 21 in the direction along the axis Ac are different from each other.

The trailing edge side suction port 22 is a rectangular opening of which the longitudinal direction is the radial direction. Unlike the leading edge side suction ports 21, the trailing edge side suction port 22 extends over substantially the entire suction surface 11B in the radial direction. That is, a dimension of the trailing edge side suction port 22 in the radial direction is larger than that of the leading edge side suction ports 21. The position of a radial outer end portion of the trailing edge side suction port 22 in the radial direction is the same as the position of a radial outer end portion of the one leading edge side suction port 21 (on a radial outer side) in the radial direction. In addition, the position of a radial inner end portion of the trailing edge side suction port 22 in the radial direction is the same as the position of a radial inner end portion of the other leading edge side suction port 21 (on a radial inner side) in the radial direction.

The inside of the stator vane main body 11 is a hollow portion, and the above-described suction portions 20 (the leading edge side suction ports 21 and the trailing edge side suction port 22) communicate with an ejection port H, which will be described later, via the hollow portion. More specifically, a flow path through which a fluid flows is formed inside the stator vane main body 11, and the suction portions 20 communicate with the ejection port H through the flow path.

The nozzle inner peripheral member 12 is provided inside the stator vane main body 11 in the radial direction. The nozzle inner peripheral member 12 has an annular shape centered on the axis Ac, and supports, from the radial inner side, the plurality of stator vane main bodies 11 that are arranged in the circumferential direction.

An inner peripheral surface 12S of the nozzle inner peripheral member 12 faces an outer peripheral surface 6S of the rotor main body 6 with a radial interval provided therebetween. A plurality of the stator vane seal fins 13 are provided on the inner peripheral surface 12S. In the present embodiment, for example, three stator vane seal fins 13 are arranged at intervals in the direction along the axis Ac. Note that the number of the stator vane seal fins 13 is not limited to three, and may be four or more. Each of the stator vane seal fins 13 protrudes radially inward from the inner peripheral surface 12S and has an annular shape extending in the circumferential direction. Each of the stator vane seal fins 13 has a tapered cross-sectional shape since a dimension thereof in the direction along the axis Ac gradually decreases toward the radial inner side from the radial outer side. A certain gap (a clearance) is formed between radial inner end portions of the stator vane seal fins 13 and the outer peripheral surface 6S of the rotor main body 6.

Figure 4:
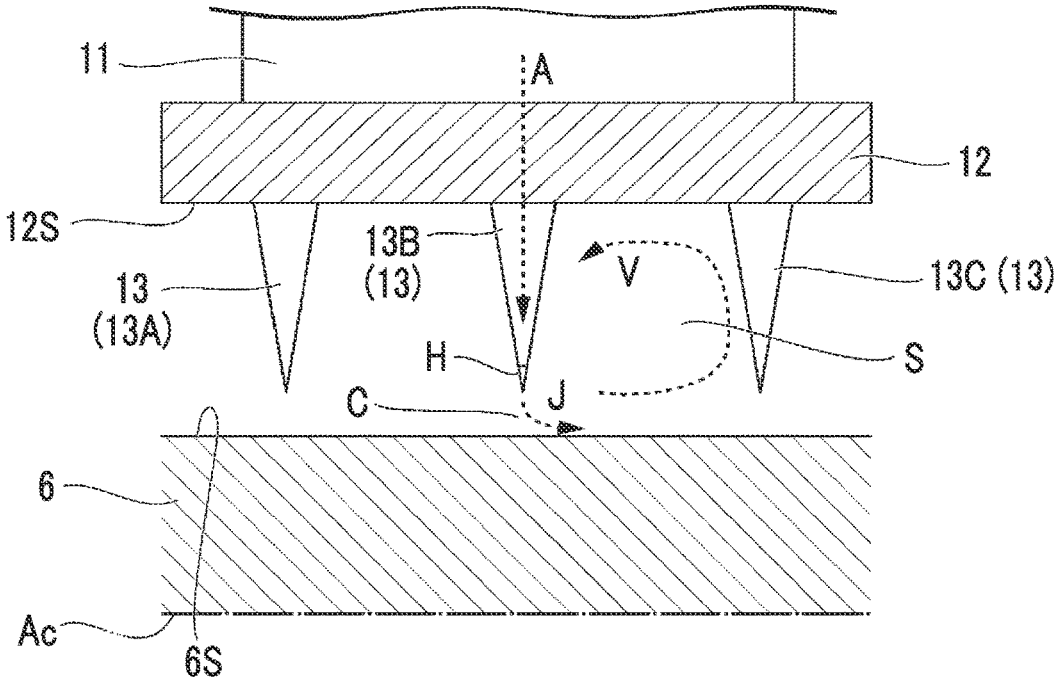
FIG. 4 is an enlarged cross-sectional view of seal fins according to the first embodiment of the present disclosure.

Next, a detailed configuration of each of the stator vane seal fins 13 will be described with reference to FIG. 4. As shown in FIG. 4, in the present embodiment, the stator vane seal fin 13 that is one of the three stator vane seal fins 13 and is positioned closest to the upstream side will be referred to as a first seal fin 13A, and the stator vane seal fin 13 that is positioned closest to the downstream side will be referred to as a third seal fin 13C. Furthermore, the stator vane seal fin 13 that is positioned between the first seal fin 13A and the third seal fin 13C will be referred to as a second seal fin 13B.

The ejection port H communicating with the above-described suction portions 20 is formed in a tip end (a radial inner end portion) of the second seal fin 13B which is one of the three stator vane seal fins 13. That is, although not shown in detail, a flow path through which the suction portions 20 and the ejection port H communicate with each other is formed in the second seal fin 13B. Here, in a space S formed between the stator vane seal fins 13, a main stream of steam (that is, a stream of steam flowing around the stator vane main body 11) is blocked by the stator vane seal fins 13, and thus, the static pressure is lower than that around the stator vane main body 11. That is, there is a pressure difference between the space S and the vicinity of the stator vane main body 11. Accordingly, a portion of steam in the vicinity of the stator vane main body 11 is sucked toward the ejection port H from the above-described suction portions 20. Sucked steam A is ejected into the space S from the ejection port H in the form of a jet J.

(Configuration of Rotor Blade)

As shown in FIG. 2, the rotor blade 8 includes a disc 61, rotor blade main bodies 81, an outer shroud 82, and rotor blade seal fins 83. The disc 61 has an annular shape centered on the axis Ac and is attached to the outer peripheral surface 6S of the rotor main body 6. A plurality of the rotor blade main bodies 81 are provided on an outer peripheral side of the disc 61. The rotor blade main bodies 81 are arranged at intervals in the circumferential direction. Although not shown in detail, each rotor blade main body 81 has a blade-like cross-sectional shape as seen in the radial direction. The outer shroud 82 is provided outside the rotor blade main bodies 81 in the radial direction. The outer shroud 82 has an annular shape centered on the axis Ac, and supports the plurality of rotor blade main bodies 81 from the radial outer side.

An outer peripheral surface 82S of the outer shroud 82 is provided with a plurality of the rotor blade seal fins 83 that are arranged at intervals in the direction along the axis Ac. The rotor blade seal fins 83 suppress a stream (a leakage stream) of steam flowing into a space between the outer shroud 82 and the inner peripheral surface 3S. In the present embodiment, four rotor blade seal fins 83 are provided, for example. Note that the number of the rotor blade seal fins 83 is not limited to four, and may be three or less or five or more. Each of the rotor blade seal fins 83 protrudes radially outward from the outer peripheral surface 82S and has an annular shape extending in the circumferential direction. Each of the rotor blade seal fins 83 has a tapered cross-sectional shape since a dimension thereof in the direction along the axis Ac gradually decreases toward the radial outer side from the radial inner side. A certain gap (a clearance) is formed between tip ends (radial outer end portions) of the rotor blade seal fins 83 and the inner peripheral surface 3S of the casing 3.

(Operation and Effect)

Next, the operation of the steam turbine 1 according to the present embodiment will be described. When the steam turbine 1 is to be operated, high-temperature and high-pressure steam generated by an external boiler or the like is supplied to the inside of the casing 3 through the steam supply port 40. Most of the steam supplied into the casing 3 alternately comes into contact with the stator vane stages 9 and the rotor blade stages 7 while flowing from the upstream side to the downstream side. The direction of flow of the steam is changed at the stator vane stages 9 such that the angle of inflow to the rotor blade stages 7 is made appropriate. When the steam flows into the rotor blade stages 7, a rotational force is applied to the rotor 2 via the rotor blade stages 7. Accordingly, the rotor 2 rotates around the axis Ac. The rotational energy of the rotor 2 is used, for example, to drive a generator (not shown) connected to a shaft end. Steam passing through the rotor blade stage 7 that is closest to the downstream side is introduced to an external condenser or the like (not shown) through the steam discharge port 50.

Meanwhile, it is known that when steam passes through the vicinity of the stator vane main body 11, a layer of a stream at which the flow velocity is low and which is called a boundary layer is formed on the surface of the stator vane main body 11 because of the viscosity of the steam. The boundary layer is particularly noticeably generated on the trailing edge 11T side of the suction surface 11B of the stator vane main body 11. In addition, in the vicinity of the leading edge 11L of the stator vane main body 11, a vortex as a secondary stream, of which the origins are both end portions in the radial direction, is likely to be formed. Because of the above-described phenomena, the steam may be hindered from flowing smoothly, and there may be a decrease in efficiency of the steam turbine 1. Furthermore, there is also a demand for improving the turbine efficiency by reducing a stream (a leakage stream) of steam flowing between the above-described stator vane seal fins 13 and the outer peripheral surface 6S of the rotor main body 6.

Therefore, in the present embodiment, a configuration is adopted in which the boundary layer and the secondary stream are sucked through the suction portions 20 described above and are supplied to the space S between the stator vane seal fins 13 through the ejection port H in the form of the jet J. In a region (the space S) surrounded by the stator vane seal fins 13, the static pressure is lower than that in a region (a main flow path) in which the main stream of steam flows. Based on such a pressure difference, a stream flowing from the suction portions 20 formed in a surface of the stator vane main body 11 to the ejection port H is formed. By being carried by the stream, steam as the boundary layer and the secondary stream is sucked from the suction portions 20. The steam sucked from the suction portions 20 is ejected to the space S between the stator vane seal fins 13 through the ejection port H. Accordingly, the boundary layer or the secondary stream formed on the surface of the stator vane main body 11 is reduced. As a result, the energy loss around the stator vane main body 11 is suppressed, and the efficiency of the steam turbine 1 can be further improved.

Furthermore, on the suction surface 11B side of the stator vane main body 11, the boundary layer or the secondary stream is particularly likely to be formed. According to the above-described configuration, the suction portions 20 are formed closer to the suction surface 11B than the leading edge 11L of the stator vane main body 11 is. Accordingly, the boundary layer and the secondary stream can be sucked more effectively, and energy loss can be further reduced. In addition, according to this configuration, opening portions as the suction portions 20 are formed only in the suction surface 11B, and thus, a decrease in strength of the stator vane main body 11 can be avoided in comparison with a case where the same opening portions are formed in the pressure surface 11A as well, for example.

In addition, the boundary layer is particularly likely to develop at a position on the suction surface 11B that is close to the trailing edge 11T side. According to the above-described configuration, the trailing edge side suction port 22 is formed at such a position where the boundary layer is likely to develop. Since the boundary layer is sucked through the trailing edge side suction port 22, a stream of steam enters a state of closely adhering to the suction surface 11B. Accordingly, the steam flows smoothly, and the energy loss of the steam turbine 1 can be further reduced.

Furthermore, a vortex as the secondary stream is particularly likely to be generated at a radial inner region and at a radial outer region of the suction surface 11B that are on the leading edge 11L side. According to the above-described configuration, the leading edge side suction ports 21 are formed at such positions where the secondary stream is likely to be generated. Since the secondary stream is sucked through the leading edge side suction ports 21, a stream of steam enters a state of more closely adhering to the suction surface 11B. As a result, the energy loss of the steam turbine 1 can be further suppressed.

Here, as shown in FIG. 4, in the space S, a vortex V is formed by a leakage stream flowing from a clearance C between the stator vane seal fins 13 and the outer peripheral surface 6S of the rotor main body 6. After the vortex V flows from the upstream side to the downstream side along the outer peripheral surface 6S, the direction of flow of the vortex V is changed along the stator vane seal fin 13 on the downstream side, and then the vortex V flows back to the upstream side along the inner peripheral surface 12S of the nozzle inner peripheral member 12.

In the above-described configuration, the ejection port H is formed at the radial inner end portion of the second seal fin 13B, which is the second seal fin counting from the one side in the direction along the axis Ac. The leakage stream flowing through the clearance C is obstructed by the jet J ejected from the ejection port H, and a contraction flow effect can be imparted to the leakage stream. Furthermore, an additional swirling force is applied to the above-described vortex V by the jet J. Development of the vortex V makes it possible to further reduce the flow rate of the leakage stream flowing into the space S. As described above, the sealing performance of the stator vane seal fins 13 is improved, and thus, the efficiency of the steam turbine 1 can be further improved.

Modification Example of First Embodiment

Figure 5:
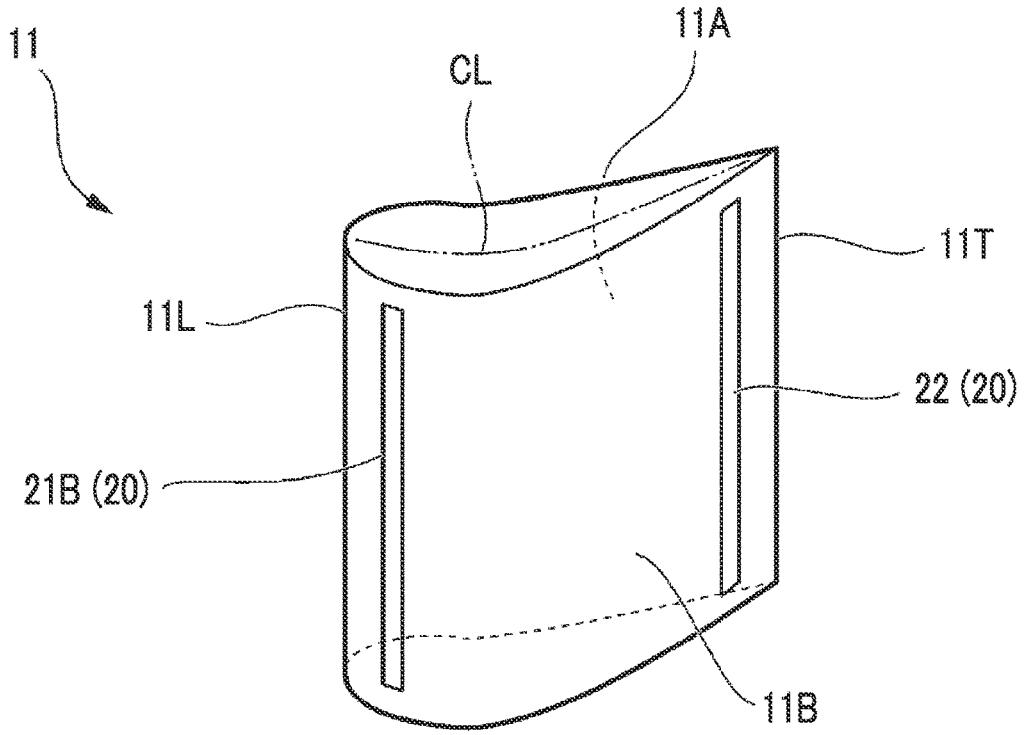
FIG. 5 is a perspective view showing a first modification example of the stator vane according to the first embodiment of the present disclosure.

The first embodiment of the present disclosure has been described above. Note that the above-described configurations can be changed and modified in various ways without departing from the gist of the present disclosure. For example, in the first embodiment, a configuration in which the paired leading edge side suction ports 21 are provided to be separated from each other in the radial direction has been described. However, as a first modification example, a configuration in which only one leading edge side suction port 21B is formed over the entire region in the radial direction as shown in FIG. 5 can also be adopted. According to such a configuration, since the leading edge side suction port 21 is formed over the entire region in the radial direction, the secondary stream can be efficiently sucked in a wider range.

Figure 6:
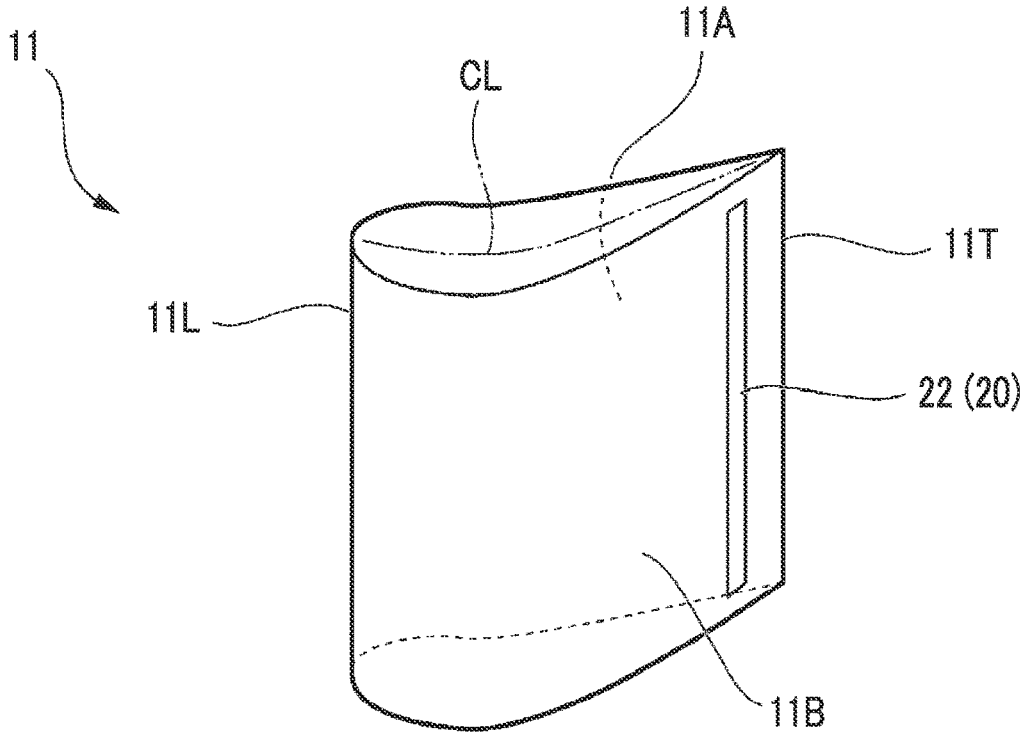
FIG. 6 is a perspective view showing a second modification example of the stator vane according to the first embodiment of the present disclosure.

Furthermore, as a second modification example, a configuration in which no leading edge side suction port 21 is formed and only the trailing edge side suction port 22 is formed as shown in FIG. 6 can also be adopted. According to such a configuration, it is possible to reduce the number of opening portions formed in the stator vane main body 11 since the leading edge side suction ports 21 are not formed. Therefore, it is possible to minimize a decrease in strength of the stator vane main body 11 while reducing the boundary layer.

Figure 7:
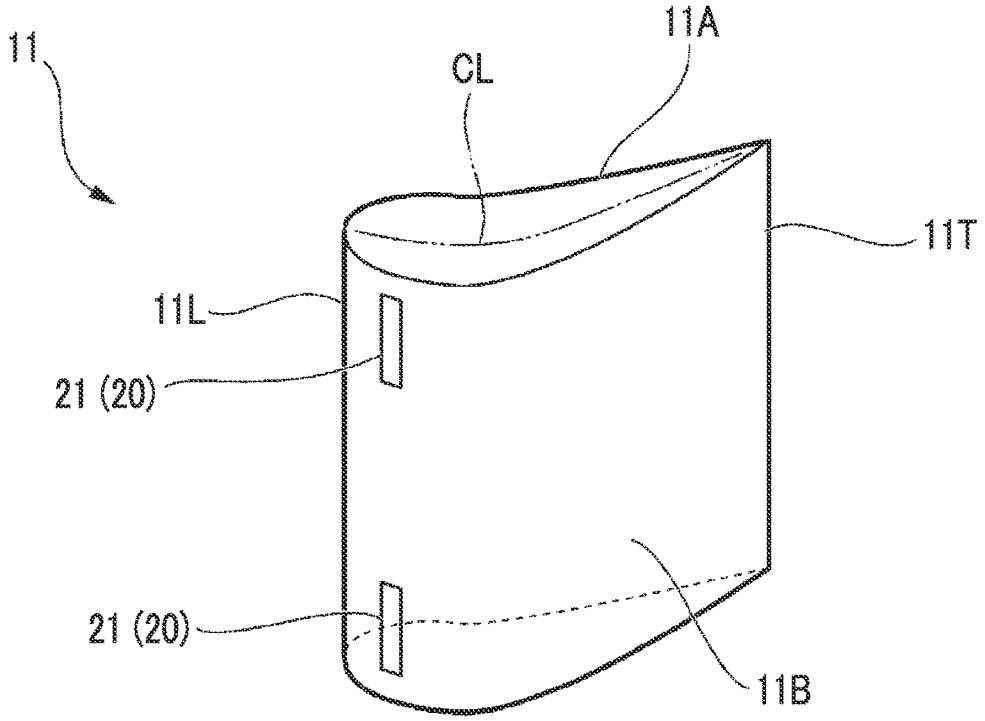
FIG. 7 is a perspective view showing a third modification example of the stator vane according to the first embodiment of the present disclosure.

In addition, as a third modification example, a configuration in which no trailing edge side suction port 22 is formed and only the leading edge side suction ports 21 are formed as shown in FIG. 7 can also be adopted. According to such a configuration, it is possible to suck and reduce the secondary stream and the boundary layer at the same time by means of the leading edge side suction ports 21. In addition, in this case as well, it is possible to reduce the number of opening portions formed in the stator vane main body 11, and thus, it is possible to minimize a decrease in strength of the stator vane main body 11 while reducing the secondary stream and the boundary layer.

Second Embodiment

Figure 8:
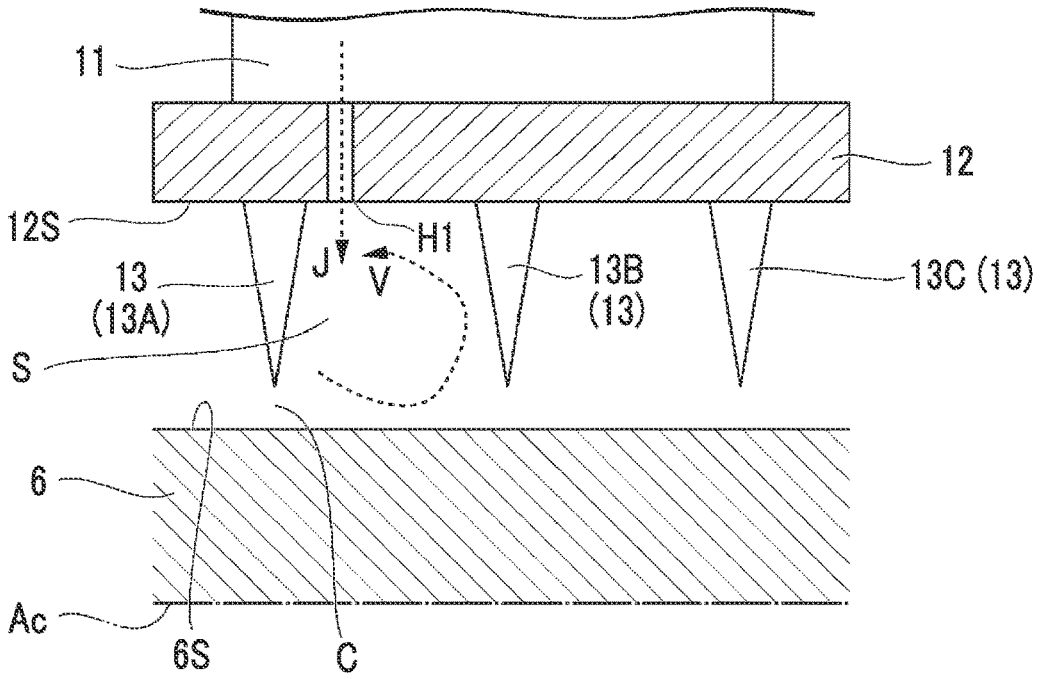
FIG. 8 is an enlarged cross-sectional view of a main portion of a steam turbine according to a second embodiment of the present disclosure.

Next, a second embodiment of the present disclosure will be described with reference to FIG. 8. Note that the same components as those in the first embodiment will be given the same reference numerals, and detailed description thereof will be omitted. As shown in FIG. 8, in the present embodiment, a position where an ejection port H1 is formed is different from that in the first embodiment.

The ejection port H1 is open at the inner peripheral surface 12S of the nozzle inner peripheral member 12. More specifically, the ejection port H1 opens into the space between the first seal fin 13A and the second seal fin 13B. Even more specifically, the ejection port H1 is formed at a position in the space S that is close to the first seal fin 13A side in the direction along the axis Ac. That is, it is possible to promote the swirling force of the vortex V with the jet J formed along the direction of flow of the vortex V formed in the space S. The ejection port H1 communicates with the suction portions 20 described in the first embodiment through a flow path F. The flow path F penetrates the nozzle inner peripheral member 12 in the radial direction.

According to the above-described configuration, steam can be supplied to a region (the space S) between the adjacent stator vane seal fins 13 through the ejection port H1 formed at the inner peripheral surface 12S of the nozzle inner peripheral member 12. Particularly, in the present embodiment, the ejection port H1 is formed at a position in the space S that is close to the first seal fin 13A side in the direction along the axis Ac. Accordingly, formation of the vortex V in the space S is promoted, and the swirling force thereof can be increased. With the development of the vortex V, the flow rate of a leakage stream flowing into the space S is reduced, and thus, the efficiency of the steam turbine 1 can be further improved.

The second embodiment of the present disclosure has been described above. Note that the above-described configurations can be changed and modified in various ways without departing from the gist of the present disclosure. For example, the position of the ejection port H1 is not limited to the inner peripheral surface 12S, and the ejection port H1 can be formed at any position on the nozzle inner peripheral member 12 and the plurality of stator vane seal fins 13 as long as the ejection port H1 is formed downstream of the first seal fin 13A. That is, although depending on the design and specifications, the ejection port H1 can also be formed at the inner peripheral surface 12S between the second seal fin 13B and the third seal fin 13C. In addition, the same ejection port H as that in the first embodiment can also be formed in the third seal fin 13C as well. Furthermore, a configuration in which the ejection port H is formed only in the third seal fin 13C can also be adopted.

Third Embodiment

Figure 9:
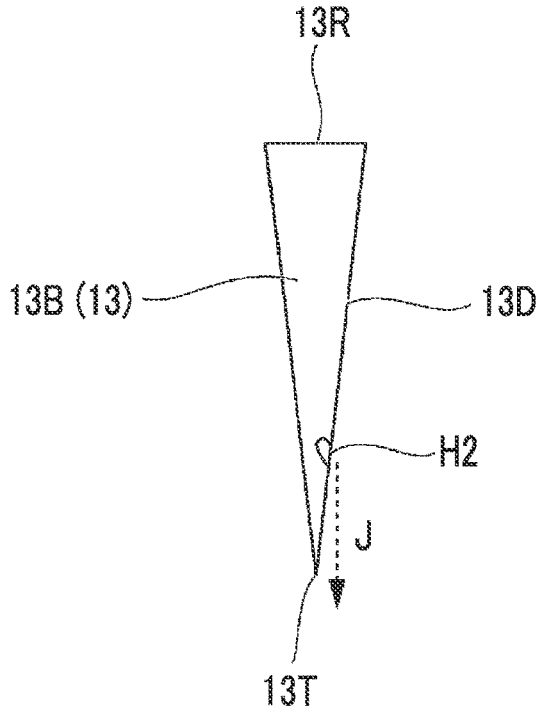
FIG. 9 is an enlarged cross-sectional view of a main portion of a steam turbine according to a third embodiment of the present disclosure.

Next, a third embodiment of the present disclosure will be described with reference to FIG. 9. The same components as those in the above-described embodiments will be given the same reference numerals, and detailed description thereof will be omitted. As shown in FIG. 9, in the present embodiment, a position where an ejection port H2 is formed in the stator vane seal fin 13 (the second seal fin 13B) is different from that in the first embodiment. In the first embodiment, the ejection port H is formed at a tip end of the stator vane seal fin 13. However, in the present embodiment, the ejection port H2 is formed at a surface (a downstream surface 13D) of the stator vane seal fin 13 that faces the downstream side. In other words, the ejection port H2 is formed at a position that is closer to the radial outer side than a tip end 13T (that is, a radial inner end portion) of the stator vane seal fin 13 is. In addition, a distance from a base end 13R (that is, a radial outer end portion) of the stator vane seal fin 13 to the ejection port H2 is larger than a distance from the tip end 13T to the ejection port H2. That is, the ejection port H2 is formed at a position closer to the tip end 13T side than the base end 13R is. In addition, a direction in which the ejection port H2 is open is set such that the jet J can be ejected radially inward.

According to the above-described configuration, steam can be supplied to the region (the space S: as with the first embodiment) between the adjacent stator vane seal fins 13 in the form of the jet J through the ejection port H2 formed in the downstream surface 13D of the stator vane seal fin 13. Accordingly, formation of a vortex in the space S is promoted. Particularly, the ejection port H2 is formed at the position that is closer to the radial outer side than the tip end 13T (that is, the radial inner end portion) of the stator vane seal fin 13 is. Accordingly, in comparison with a case where the ejection port H2 is formed at the tip end 13T, the jet J can be more adapted to a vortex stream, for example. That is, the swirling force of the vortex can be further increased by the jet J, and the vortex can be developed. With the development of the vortex, a leakage stream flowing in the clearance C is reduced, and thus, the efficiency of the steam turbine 1 can be further improved.

Modification Example of Third Embodiment

Figure 10:
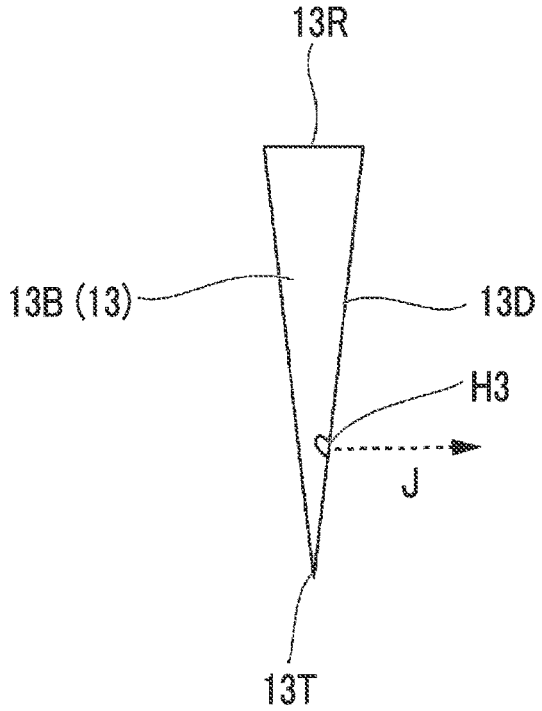
FIG. 10 is an enlarged cross-sectional view showing a main portion of a first modification example of the steam turbine according to the third embodiment of the present disclosure.
Figure 11:
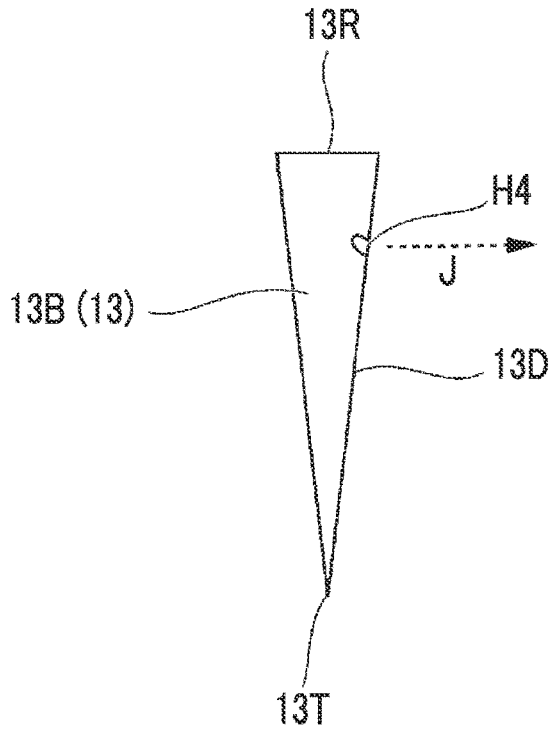
FIG. 11 is an enlarged cross-sectional view showing a main portion of a second modification example of the steam turbine according to the third embodiment of the present disclosure.
Figure 12:
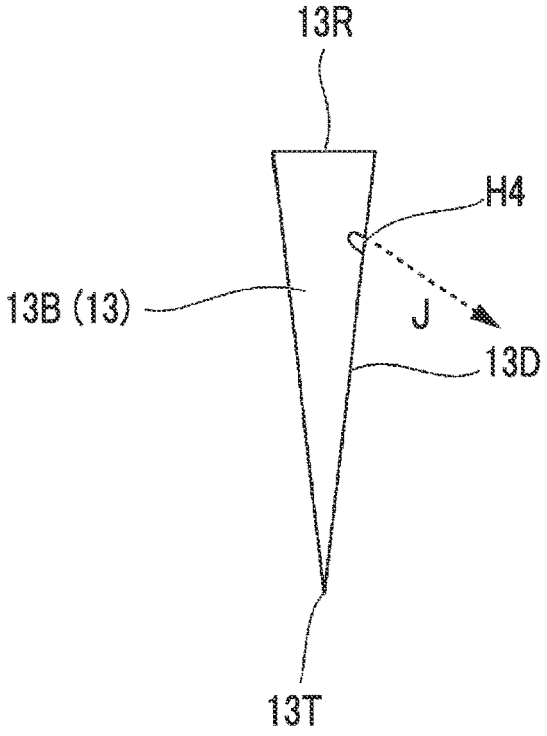
FIG. 12 is an enlarged cross-sectional view showing a main portion of a third modification example of the steam turbine according to the third embodiment of the present disclosure.

The third embodiment of the present disclosure has been described above. Note that the above-described configurations can be changed and modified in various ways without departing from the gist of the present disclosure. For example, as a first modification example of the third embodiment, a configuration in which a direction in which an ejection port H3 is open is set such that the jet J is ejected toward the downstream side as shown in FIG. 10 can also be adopted. In addition, as a second modification example, a configuration in which an ejection port H4 through which the jet J is ejected to the downstream side is formed at a position close to the base end 13R side as shown in FIG. 11 can also be adopted. Note that the direction in which the ejection port H3 (H4) is open may be set such that, for example, the jet J is formed to become closer to the radial inner side toward the downstream side as shown in FIG. 12 as long as a direction component toward the downstream side is included. In addition, the direction in which the ejection port is open may be set such that the jet J is formed to become closer to the radial outer side toward the downstream side. According to such configurations, it is possible to promote formation of a vortex and to further reduce the flow rate of a leakage stream flowing into the space S. As a result, the efficiency of the steam turbine 1 can be further improved.

Modification Example Common to All Embodiments

Note that, in each of the above embodiments, the configuration of the stator vane 10 has been described with the steam turbine 1 used as an example. However, the target of application of a configuration corresponding to the stator vane 10 (the suction portions 20 and the ejection ports H, H1, H2, H3, and H4) is not limited to the steam turbine 1, and the configuration can also be applied to a turbine unit of a gas turbine.

APPENDIX

The steam turbine 1 described in the embodiments is understood as follows, for example.

(1) The steam turbine 1 according to a first aspect includes the rotor 2 that includes the rotor main body 6 rotatable around the axis Ac and the plurality of rotor blades 8 arranged in the circumferential direction along the outer peripheral surface 6S of the rotor main body 6, the casing 3 that covers the rotor 2, and the plurality of stator vanes 10 that are arranged in the circumferential direction along the inner peripheral surface 33 of the casing 3. The stator vanes 10 each include the stator vane main body 11 that extends in the radial direction with respect to the axis Ac and that includes a surface in which the suction portion 20, through which at least a portion of a working fluid flowing from one side to the other side in a direction along the axis Ac is suckable, is formed, the nozzle inner peripheral member 12 that is provided inside the stator vane main body 11 in the radial direction, and the plurality of seal fins (the stator vane seal fins 13) that protrude radially inward from the inner peripheral surface 12S of the nozzle inner peripheral member 12 and that are arranged at intervals in the direction along the axis Ac, and the ejection port H through which the working fluid introduced through the suction portion 20 is ejected is formed in the nozzle inner peripheral member 12 and in a portion of the seal fin that is closer to the other side in the direction along the axis Ac than the seal fin closest to the one side in the direction along the axis Ac is.

In a region surrounded by the plurality of seal fins (the stator vane seal fins 13), the static pressure is lower than that in a region (a main flow path) in which the main stream of steam flows. Based on such a pressure difference, a portion of the working fluid is sucked toward the ejection port H from the suction portion 20 formed in a surface of the stator vane main body 11. Accordingly, a boundary layer or a secondary stream formed on the surface of the stator vane main body 11 can be sucked. As a result, the occurrence of energy loss can be suppressed in the vicinity of the stator vane main body 11.

(2) In the steam turbine 1 according to a second aspect, the suction portion 20 may be formed closer to the suction surface 11B than the leading edge 11L of the stator vane main body 11 is.

On the suction surface 11B side, the boundary layer or the secondary stream is particularly likely to be formed. According to the above-described configuration, the suction portions 20 are formed closer to the suction surface 11B than the leading edge 11L of the stator vane main body 11 is. Accordingly, the boundary layer and the secondary stream can be sucked more effectively, and energy loss can be further reduced.

(3) In the steam turbine 1 according to a third aspect, the suction portion 20 includes the trailing edge side suction port 22 formed at a position on the suction surface 11B of the stator vane main body 11 that is close to the trailing edge 11T side, the trailing edge side suction port 22 extending over an entire region in the radial direction.

A boundary layer is particularly likely to develop at the position on the suction surface 11B that is close to the trailing edge 11T side. According to the above-described configuration, the trailing edge side suction port 22 is formed at such a position where the boundary layer is likely to develop. Since the boundary layer is sucked through the trailing edge side suction port 22, energy loss can be further reduced.

(4) In the steam turbine 1 according to a fourth aspect, the suction portion 20 may include the leading edge side suction port 21 formed at a position on the suction surface 11B of the stator vane main body 11 that is close to the leading edge 11L side, the leading edge side suction port 21 being positioned at at least one of a portion on a radial inner side and a portion on a radial outer side.

A vortex as a secondary stream is particularly likely to be generated at a radial inner region and at a radial outer region of the suction surface 11B that are on the leading edge 11L side. According to the above-described configuration, the leading edge side suction ports 21 are formed at such positions where the secondary stream is likely to be generated. Since the secondary stream is sucked through the leading edge side suction port 21, energy loss can be further suppressed.

(5) In the steam turbine 1 according to a fifth aspect, the leading edge side suction port 21 may extend over an entire region in the radial direction.

According to the above-described configuration, since the leading edge side suction port 21 is formed over the entire region in the radial direction, the secondary stream can be efficiently sucked in a wider range.

(6) In the steam turbine 1 according to a sixth aspect, the ejection port H1 may be formed in the inner peripheral surface 12S of the nozzle inner peripheral member 12.

According to the above-described configuration, the working fluid can be supplied to a region (the space S) between the adjacent seal fins (the stator vane seal fins 13) through the ejection port H1 formed at the inner peripheral surface 12S of the nozzle inner peripheral member 12. Accordingly, formation of a vortex in the region can be promoted. With the development of the vortex, the flow of a leakage stream is reduced, and thus, the efficiency of the steam turbine 1 can be further improved.

(7) In the steam turbine 1 according to a seventh aspect, the ejection port H may be formed in a radial inner end portion of one of the plurality of seal fins (the stator vane seal fins 13) that is the second or subsequent seal fin counting from the one side in the direction along the axis Ac.

In the above-described configuration, the ejection port H is formed at the radial inner end portion of the second seal fin counting from the one side in the direction along the axis Ac. Accordingly, a contraction flow effect can be imparted to a leakage stream flowing through a clearance formed between the seal fin and the rotor main body 6. As a result, the leakage stream is reduced, and the efficiency of the steam turbine 1 can be further improved.

(8) In the steam turbine 1 according to an eighth aspect, the ejection port H2 may be formed in a surface of one of the plurality of seal fins (the stator vane seal fins 13) that is the second or subsequent seal fin counting from the one side in the direction along the axis Ac and may be configured such that the working fluid is ejected radially inward, the surface facing the other side in the direction along the axis Ac.

According to the above-described configuration, the working fluid can be supplied to a region (the space S) between the adjacent seal fins through the ejection port H2 formed at a surface of the seal fin that faces the downstream side. Accordingly, formation of a vortex in the region can be promoted. With the development of the vortex, a leakage stream is reduced, and thus, the efficiency of the steam turbine 1 can be further improved.

(9) In the steam turbine 1 according to a ninth aspect, the ejection port H3 may be formed in a surface of one of the plurality of seal fins (the stator vane seal fins 13) that is the second or subsequent seal fin counting from the one side in the direction along the axis Ac and may be configured such that the working fluid is ejected with a direction component toward the other side in the direction along the axis Ac, the surface facing the other side in the direction along the axis Ac.

According to the above-described configuration, the working fluid can be supplied to a region (the space S) between the adjacent seal fins through the ejection port H3 formed at a surface of the seal fin that faces the downstream side. Particularly, the working fluid is ejected from the ejection port H3 with a direction component toward the downstream side. Accordingly, a leakage stream passing through the region can be further reduced. As a result, the efficiency of the steam turbine 1 can be further improved.

INDUSTRIAL APPLICABILITY

According to the present disclosure, it is possible to provide a steam turbine with a further improvement in efficiency.

REFERENCE SIGNS LIST

1: steam turbine
2: rotor
3: casing
3S: inner peripheral surface
4: journal bearing
5: thrust bearing
6: rotor main body
6S: outer peripheral surface
7: rotor blade stage
8: rotor blade
9: stator vane stage
10: stator vane
11: stator vane main body
11A: pressure surface
11B: suction surface
11L: leading edge
11T: trailing edge
12: nozzle inner peripheral member
12S: inner peripheral surface
13: stator vane seal fin
13A: first seal fin
13B: second seal fin
13C: third seal fin
13D: downstream surface
13R: base end
13T: tip end
20: suction portion
21, 21B: leading edge side suction port
22: trailing edge side suction port
31: nozzle outer peripheral member
40: steam supply port
50: steam discharge port
61: disc
81: rotor blade main body
82: outer shroud
82S: outer peripheral surface
83: rotor blade seal fin
Ac: axis
C: clearance
CL: camber line
F: flow path
H, H1, H2, H3, H4: ejection port
J: jet
S: space
V: vortex

The invention claimed is:

1. A turbine comprising:

a rotor that includes a rotor main body rotatable around an axis and a plurality of rotor blades arranged in a circumferential direction along an outer peripheral surface of the rotor main body;

a casing that covers the rotor; and a plurality of stator vanes that are arranged in the circumferential direction along an inner peripheral surface of the casing, wherein the stator vanes each include a stator vane main body that extends in a radial direction with respect to the axis and that includes a surface in which a suction portion, through which at least a portion of a working fluid flowing from one side to the other side in a direction along the axis is suckable, is formed, a nozzle inner peripheral member that is provided inside the stator vane main body in the radial direction, and a plurality of seal fins that protrude radially inward from an inner peripheral surface of the nozzle inner peripheral member and that are arranged at intervals in the direction along the axis, and an ejection port through which the working fluid introduced through the suction portion is ejected is formed in the nozzle inner peripheral member and in a portion of the seal fin that is closer to the other side in the direction along the axis than the seal fin closest to the one side in the direction along the axis is, wherein the suction portion includes a trailing edge side suction port formed at a position on a suction surface of the stator vane main body that is close to a trailing edge side, the trailing edge side suction port extending over an entire region in the radial direction.

2. The turbine according to claim 1, wherein the suction portion is at least partially located on the suction surface.

3. The turbine according to claim 1, wherein the suction portion includes a leading edge side suction port formed at a position on the suction surface of the stator vane main body that is close to a leading edge side, the leading edge side suction port being positioned at least one of a portion on a radial inner side and a portion on a radial outer side.

4. The turbine according to claim 3, wherein the leading edge side suction port extends over an entire region in the radial direction.

5. A turbine comprising:

a rotor that includes a rotor main body rotatable around an axis and a plurality of rotor blades arranged in a circumferential direction along an outer peripheral surface of the rotor main body;

a casing that covers the rotor; and a plurality of stator vanes that are arranged in the circumferential direction along an inner peripheral surface of the casing, wherein the stator vanes each include a stator vane main body that extends in a radial direction with respect to the axis and that includes a surface in which a suction portion, through which at least a portion of a working fluid flowing from one side to the other side in a direction along the axis is suckable, is formed, a nozzle inner peripheral member that is provided inside the stator vane main body in the radial direction, and a plurality of seal fins that protrude radially inward from an inner peripheral surface of the nozzle inner peripheral member and that are arranged at intervals in the direction along the axis, and an ejection port through which the working fluid introduced through the suction portion is ejected is formed in the nozzle inner peripheral member and in a portion of the seal fin that is closer to the other side in the direction along the axis than the seal fin closest to the one side in the direction along the axis is, wherein the ejection port is formed in a radial inner end portion of one of the plurality of seal fins that is a second or subsequent seal fin counting from the one side in the direction along the axis.

6. A turbine comprising:

a rotor that includes a rotor main body rotatable around an axis and a plurality of rotor blades arranged in a circumferential direction along an outer peripheral surface of the rotor main body;

a casing that covers the rotor; and a plurality of stator vanes that are arranged in the circumferential direction along an inner peripheral surface of the casing, wherein the stator vanes each include a stator vane main body that extends in a radial direction with respect to the axis and that includes a surface in which a suction portion, through which at least a portion of a working fluid flowing from one side to the other side in a direction along the axis is suckable, is formed, a nozzle inner peripheral member that is provided inside the stator vane main body in the radial direction, and a plurality of seal fins that protrude radially inward from an inner peripheral surface of the nozzle inner peripheral member and that are arranged at intervals in the direction along the axis, and an ejection port through which the working fluid introduced through the suction portion is ejected is formed in the nozzle inner peripheral member and in a portion of the seal fin that is closer to the other side in the direction along the axis than the seal fin closest to the one side in the direction along the axis is, wherein the ejection port is formed in a surface of one of the plurality of seal fins that is a second or subsequent seal fin counting from the one side in the direction along the axis and is configured such that the working fluid is ejected radially inward, the surface facing the other side in the direction along the axis.

7. The turbine according to claim 1, wherein the ejection port is formed in a surface of one of the plurality of seal fins that is a second or subsequent seal fin counting from the one side in the direction along the axis and is configured such that the working fluid is ejected with a direction component toward the other side in the direction along the axis, the surface facing the other side in the direction along the axis.

* * * * *